United States Patent [19]

Bosshard et al.

[11] 3,941,321

[45] Mar. 2, 1976

[54] WINDING DEVICE WITH AUTOMATIC TUBE CHANGE OPERATION

[75] Inventors: Peter Bosshard; Werner Portmann, both of Winterthur; Olivier Wüst, Seuzach, all of Switzerland

[73] Assignee: Rieter Machine Works Ltd., Winterthur, Switzerland

[22] Filed: Mar. 4, 1974

[21] Appl. No.: 447,852

[30] Foreign Application Priority Data

Dec. 13, 1973 Switzerland ..... 17436/73

[52] U.S. Cl. ..... 242/18 A; 242/18 DD

[51] Int. Cl.[2] ..... B65H 67/04; B65H 54/42

[58] Field of Search ..... 242/18 A, 18 DD

[56] References Cited

UNITED STATES PATENTS

| | | | |
|---|---|---|---|
| 2,905,402 | 9/1959 | Foller et al. | 242/18 A |
| 3,559,902 | 2/1971 | Brock | 242/18 A |
| 3,825,206 | 7/1974 | Schippers et al. | 242/18 A X |

*Primary Examiner*—Stanley N. Gilreath
*Attorney, Agent, or Firm*—Werner W. Kleeman

[57] ABSTRACT

A winding device for endless threads for automatically exchanging a fully wound bobbin tube against an empty tube, comprising at least two bobbin chucks for taking-up the tubes, and which bobbin chucks are arranged upon a pivotable arm. The bobbin tubes are alternately brought into contact, during pivoting of the pivotal arm, first with the circumference of an accelerating ring and then with the circumference of a friction drive drum. The circumferential speed of the accelerating ring exceeds that of the friction drive drum. The accelerating ring can be driven independent of the friction drive drum.

3 Claims, 4 Drawing Figures

WINDING DEVICE WITH AUTOMATIC TUBE CHANGE OPERATION

BACKGROUND OF THE INVENTION

The present invention relates to a new and improved construction of winding device for automatically changing tubes for taking-up endless threads or the like.

Devices of this type are suitable in particular for use in spin-draw-winding during the manufacture of man-made fibers.

Winding devices for endless threads or the like are already known to the art wherein a tube placed upon a pivotably arranged bobbin chuck arm is pivoted into a winding position. Prior to contacting a friction drive drum which is provided for the purpose of driving the tube, the latter is accelerated by an accelerating ring provided at one end of the friction drive drum so as to possess a slightly higher rotational speed than the rotational speed prevailing during the winding operation. With this arrangement the accelerating ring is coaxially connected with the friction drive drum and its diameter is selected to be larger by a certain amount than that of the friction drive drum itself.

A drawback of such prior art winding device resides in the fact that the synchronous motor employed for driving the friction drive drum must be designed for winding the bobbin package and for the acceleration of the tube which is only required for a short period of time, in other words, must fulfill power requirements which are as much as four times greater than actually needed for merely driving the friction drive drum, in order to insure that the winding of the bobbin package, which is still in progress, while the next following empty tube is accelerated for the bobbin tube change operation, is not endangered by a reduction in the rotational speed or by a falling-out of step of the synchronous motor or the friction drive drum respectively.

A further disadvantage of the aforementioned state-of-the-art system resides in the fact that there is present a fixed difference between the circumferential speed of the accelerating ring and that of the friction drive drum. This drawback is manifested by virtue of the fact that there cannot be taken into consideration the differing thread take-up speeds generated by different thread traversing speeds at constant rotational speeds of the friction drive drum and the differing thread take-up tension at the bobbin tube change caused by virtue of the fact that the thread of necessity is not traversed during the times that there are formed the thread reserve windings. By changing the thread traversing speed with constant rotational speed it is possible to accommodate to the momentarily prevailing requirements the crossing angles of the threads or the like wound onto the bobbin package.

SUMMARY OF THE INVENTION

Hence, it is a primary object of the present invention to provide an improved construction of winding device for automatically changing tubes for taking-up endless threads or the like which is not associated with the aforementioned drawbacks and limitations of the prior art constructions.

Another and more specific object of the present invention aims at eliminating the previously mentioned disadvantages prevailing with the state-of-the-art proposals and to realize the possibility of reducing the torque or momentum, which causes the friction drive drum to fall out-of-step, to a magnitude required for the winding process and to permit a simple adaptation of the rotational speed of the accelerating ring to the increased circumferential speed of the bobbin tube needed for the bobbin tube change.

Now, in order to implement these and still further objects of the invention, which will become more readily apparent as the description proceeds, the invention contemplates the provision of a winding device for endless threads or the like for automatically exchanging a fully wound bobbin tube against an empty tube, comprising at least two bobbin chucks for taking-up or accommodating the tubes and arranged upon a pivotable arm. The tubes are alternately brought into contact, during pivoting of the arm, first with the circumference of an accelerating ring and thereafter with the circumference of a friction drive drum, the circumferential speed of the accelerating ring exceeding that of the friction drive drum. Means are provided for separately driving the accelerating ring from the friction drive drum.

Moreover, the accelerating ring can be arranged in such a manner that it only partially extends beyond the circumference of the friction drive drum and specifically in such a way that the circumference of the friction drive drum is exceeded at a zone, which, viewed in the pivoting direction of the tube, is located in front of a zone at which the tube in its winding position contacts the friction drive drum.

BRIEF DESCRIPTION OF THE DRAWINGS

The invention will be better understood and objects other that those set forth above, will become apparent when consideration is given to the following detailed description there. Such description makes reference to the annexed drawings wherein.

DETAILED DESCRIPTION OF THE PREFERRED EMBODIMENTS

Figure 1:
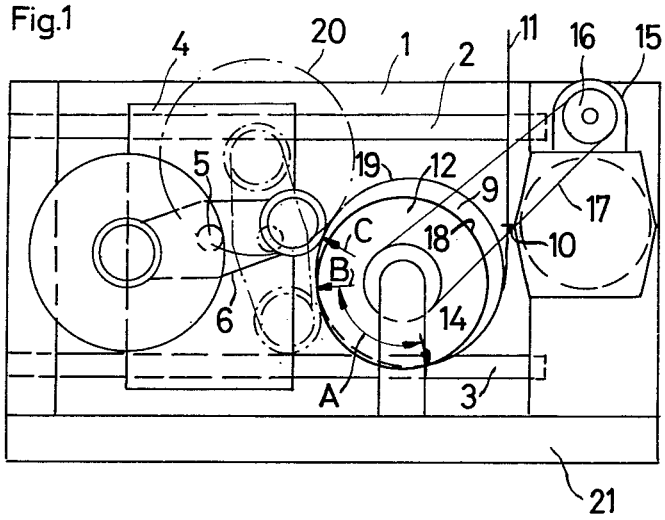
FIG. 1 is an elevational view of an embodiment of winding device or winder designed according to the invention wherein the bobbin chucks are shown in solid lines in their winding position, i.e., after the bobbin change, and in phantom lines in the position which they assume during the bobbin change, particularly during acceleration of the empty tube.

Describing now the drawings, it is to be understood, that only enough of the structure of the winding device of this development has been shown in the drawings to enable those skilled in the art to understand and appreciate the underlying concepts of this development. Thus, by referring to FIG. 1 there will be recognized a winding device or winder 1 which is equipped with a carriage 4 which is slidably supported by parallel rails 2 and 3 which are rigidly mounted at the machine frame. This carriage 4 is equipped with a shaft 5 which pivotably supports a pivotal or pivotable arm 6 which can be pivoted in the counter-clockwise direction about the shaft 5 and arrested in desired position. Bobbin chucks 7 and 7' are seated upon the pivotable arm 6, these chucks serving to take-up or support a respective tube 8 and 8'. These bobbin chucks 7 and 7' are mounted so as to be axially shiftable. A friction drive drum 9 serves to selectively drive the bobbin chucks 7 and 7' respectively while transferring a thread 11 which is traversed to-and-fro by a traversing thread guide 10 for the purpose of building a bobbin package. Means suitable for this purpose are well known in the art, for instance as has been taught in Swiss patent 513,763, the disclosure of which is incorporated herein by reference, so that further discussion thereof can be dispensed with.

Figure 2:
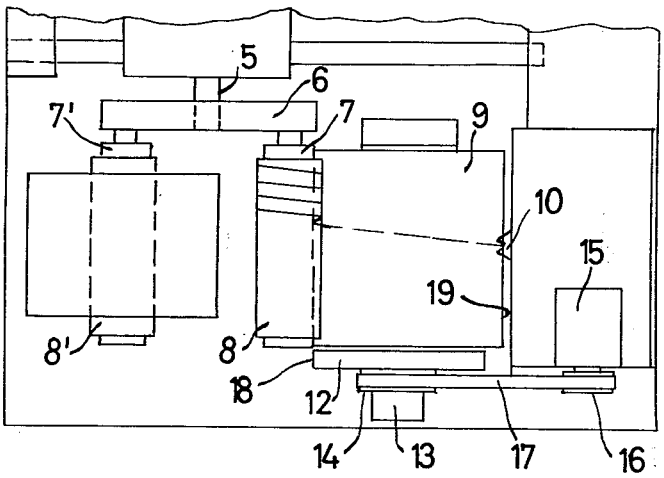
FIG. 2 is a top plan view of the winding device depicted in FIG. 1 and illustrating the bobbin chucks in the winding position according to FIG. 1.
Figure 4:
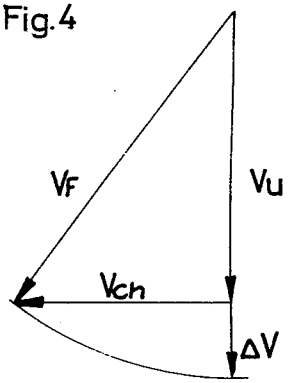
FIG. 4 is a vector diagram portraying the speed of the thread, the circumferential speed of the friction drive drum, and the speed of the thread traversing motion.

At the end face of the friction drive drum 9 which is spaced from the pivotal or pivotable arm 6, but in spaced relationship from said end face, there is provided an acceleration ring 12, for instance as best seen by referring to FIG. 2. This acceleration ring 12 is rotatably supported at a support member 13 which is rigidly connected to a base plate 21 of the winding device 1. The accelerating ring 12 can be driven by a suitable drive means, here in the form of for instance a belt pulley 14 which is arranged at its end face, as shown in FIG. 2, and which belt pulley 14 in turn is driven by a drive motor 15 equipped with a drive pulley 16 through the agency of a belt 17 which is trained about both of the pulleys 14 and 16. The rotational speed of the accelerating ring 12 can be altered by selecting the diameters of the belt pulleys 14 and 16 or by using a drive motor 15 which can be regulated as concerns its rotational speed. The rotational speed or the circumferential speed respectively, of the accelerating ring 12 is chosen in relation to the circumferential speed of the friction drive drum 9 such that the thread tension during the bobbin tube change is substantially maintained while the thread reserve is formed and the thread traversing motion is thus necessarily interrupted, i.e. the circumferential speed of the accelerating ring 12 must exceed the circumferential speed $V_U$ (FIG. 4) of the friction drive drum 9 by the amount $\Delta V$ in such manner that the thread take-up speed $V_F$ effective during the winding process owing to the thread traversing speed $V_{ch}$ is also maintained during the bobbin tube exchange operation during which the thread is not traversed to-and-fro.

Figure 3:
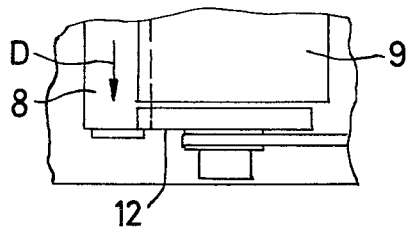
FIG. 3 is a fragmentary top plan view of the winding device shown in FIG. 1, and illustrating the bobbin chuck position corresponding to acceleration of the empty tube as shown in FIG. 1.

The accelerating ring 12 is arranged with respect to the friction drive drum 9 in such a manner that its circumference 18 extends beyond the circumference 19 of the friction drive drum 9 at a zone or region designated by reference character A in FIG. 1 within which zone A the empty tube 8 (FIG. 3) is accelerated, and furthermore that the previously mentioned enlarged portion of the circumference 18, however, is zero at a point designated by reference character B in FIG. 1 and subsequently the circumference 18 of the accelerating ring 12 becomes less than the circumference 19 of the friction drive drum 9 at a point designated by reference character C in FIG. 1. This point or location C corresponds to the point of contact of the tube 8 with the friction drive drum 9 while the pivotable arm 6 is in its winding position. The point or location B where the empty tube 8 simultaneously contacts the circumference 18 of the accelerating ring 12 and the circumference 19 of the friction drive drum 9 corresponds to a change point at which the empty tube 8 already has taken over the thread 11 or the like in any suitable manner which is not really essential for understanding the development of the present invention, but may be, for instance, as described in the aforementioned Swiss Pat. No. 513,763, and at which location the thread 11 is again traversed to-and-fro.

During the bobbin tube change operation, the empty tube 8 is brought into the position indicated in phantom lines in FIG. 1, i.e. into a position where, on the one hand, the thread is still connected with a full bobbin 20 which is still driven by the friction drive drum 9, and, on the other hand, the next following or subsequent empty tube 8 for taking-up the next bobbin package contacts the circumference 18 of the accelerating ring 12 in order to be accelerated. The empty tube 8 is brought into contact with the accelerating ring 12 during such time as the bobbin chuck 7, or as the case may be for the next following bobbin tube change operation, the bobbin chuck 7', is axially shifted in the direction D (FIG. 3) while it is pivoted into the previously mentioned acceleration or accelerating position. Upon the elapse of a certain time, predetermined by a control device (not shown), as required for accelerating the tube 8, this empty tube 8 is further pivoted counter-clockwise until reaching the winding position, i.e. until the empty tube 8 reaches the position designated by reference character C at the friction drive drum 9. While the empty tube 8 is pivoted, in other words during rolling-off of the empty tube 8 along the zone A on the circumference 18 of the accelerating ring 12 up to the point or location B, the bobbin chuck is again axially shifted back to the position shown in FIG. 2. During this pivoting motion, the thread 11 still connected with the full bobbin 20, but no longer traversing to-and-fro, is engaged or seized by a thread catching and cutting zone (not shown) of the bobbin chuck and is severed and subsequently several reserve winding wraps are placed onto the tube 8, and during further pivoting or rolling respectively, into the winding position or respectively into the position designated by reference character C the normal thread traversing is again started.

Instead of using an axially movable bobbin chuck, there can be used a bobbin chuck or a tube which can be extended or lengthened until contacting the accelerating ring, in order to render possible contact between the tube and the accelerating ring.

Some of the more notable advantages of the present invention can be enumerated as follows:

a. The motor driving the friction drive drum can be chosen independent of the power requirements for accelerating the empty tube and thus there are present more favorable frequency converter requirements;

b. The motor driving the accelerating ring is in operation only during the bobbin tube change process and thus can take correspondingly higher loads;

c. The rotational speed of the accelerating ring can be adapted in relatively simple manner to the thread traversing speed, to the circumferential speed of the friction drive drum and to the variable thread-takeup speed in such a way that the thread tension during the thread transfer and during the thread reserve formation can be maintained at the same level as during the thread traversing phase;

d. The accelerating ring can be arranged in relation to the friction drive drum such that the accelerating ring circumference extends beyond the circumference of the friction drive drum only in the pivoting zone of the empty tube during the bobbin tube change operation, at which zone the empty tube is to be accelerated and at which zone the transfer of the tube from the accelerating ring to the friction drive drum is approximately tangential, and thus there is carried out a very gentle transfer operation; and e. The accelerating ring together with the empty tube already contacting such accelerating ring can be accelerated, and thus damage to the cover sheet of the tube caused by sliding friction is prevented.

While there is shown and described present preferred embodiments of the invention, it is to be distinctly understood that the invention is not limited thereto, but may be otherwise variously embodied and practiced within the scope of the following claims. ACCORDINGLY,

What is claimed is:

1. A winding device for endless threads or the like for automatically exchanging a fully wound bobbin tube against an empty tube, comprising a pivotable arm, at least two bobbin chucks for taking-up the tubes arranged upon said pivotable arm, an accelerating ring and a friction drive drum, the circumferential speed of the accelerating ring exceeding that of the friction drive drum, means for mounting the accelerating ring relative to the friction drive drum wherein the accelerating ring and the friction drive drum are arranged axially alongside one another such that the circumference of the accelerating ring radially extends partly beyond a portion of the circumference of the friction drive drum in the direction of the empty tube so as to be engaged thereby, and during the movement of the empty tube from a first position of pivotable arm movement wherein the empty tube contacts the circumference of the accelerating ring to a second position of the pivotable arm movement wherein the empty tube contacts the circumference of the friction drive drum, the continued pivoting of the pivotable arm from said first position to said second position disengages the empty tube from the accelerating ring and engages the empty tube with the friction drive drum.

2. The winding device as defined in claim 1, wherein the circumference of the accelerating ring extends beyond the circumference of the friction drive drum at a zone which, viewed in the direction of pivoting of the empty tube, is located in front of a zone at which the empty tube in its winding position contacts the friction drive drum.

3. The winding device as defined in claim 1 including means for driving the accelerating ring independently of the friction drive drum.

* * * * *